US005351219A

United States Patent [19]

Adachi et al.

[11] Patent Number: 5,351,219

[45] Date of Patent: Sep. 27, 1994

[54] ACOUSTIC DEVICE

[75] Inventors: Hideo Adachi, Iruma; Yoshihiro Ishibashi, Nagoya, both of Japan

[73] Assignee: Olympus Optical Co., Ltd., Tokyo, Japan

[21] Appl. No.: 830,947

[22] Filed: Feb. 4, 1992

[30] Foreign Application Priority Data

Feb. 8, 1991 [JP] Japan ..... 3-017984

[51] Int. Cl.[5] ..... H04R 17/00

[52] U.S. Cl. ..... 367/140; 367/150; 367/157; 310/335; 333/144; 333/147; 333/152

[58] Field of Search ..... 367/150, 140, 157; 310/335; 333/144, 141, 147, 149, 150, 152, 154

[56] References Cited

U.S. PATENT DOCUMENTS

| | | | |
|---|---|---|---|
| 3,737,811 | 6/1973 | Paige | 333/72 |
| 3,790,907 | 2/1974 | Alexander | 333/144 |
| 3,840,826 | 10/1974 | Toda et al. | 333/30 R |
| 3,848,144 | 11/1974 | Schissler | 310/8.1 |
| 4,401,956 | 8/1983 | Joshi | 333/152 |
| 4,452,084 | 6/1984 | Taenzer | 73/609 |

FOREIGN PATENT DOCUMENTS 54-128326 4/1979 Japan .

OTHER PUBLICATIONS

Development of a 12 Element Annular Array Transducer for Realtime Ultrasound Imaging; Foster et al; Ultrasound in Med. & Biol., vol. 15, No. 7, pp. 649–659, 1989.

Handbook on Ultrasonic; 3. Practical Application of Ultrasonic to a Circuit Device; 3-1 Ultrasonic Delay Lines, pp. 765–789.

Physica B 150 (1988), The Ferroelastic Transition in Some Scheelite-Type Crystals, Yoshihiro Ishibashi et al, pp. 258–264.

*Primary Examiner*—J. Woodrow Eldred

*Attorney, Agent, or Firm*—Frishauf, Holtz, Goodman & Woodward

[57] ABSTRACT

An acoustic device has an acoustic wave propagating medium exhibiting elastic abnormality in the vicinity of a Curie temperature. It is desirable that such an acoustic wave propagating medium be formed of a ferroelectric substance or a high-elastic substance and, in particular, have a Curie temperature at normal temperatures. For example, such ferroelectric substance is a solid solution expressed by $Cs(Pb_{1-x}Sr_x)(Cl_{1-y}Br_y)_3$ or $(Bi_{1-x}Dy_x)VO_4$. By changing values of x and y appropriately, the Curie temperature of the solid solution can be varied, and an acoustic wave propagating medium meeting the purpose of use can be obtained. In such an acoustic wave propagating medium, an elastic coefficient $C^P$ at the time of constant polarization differs greatly from an elastic coefficient $C^E$ at the time of a constant electric field in the vicinity of the Curie temperature. Accordingly, the propagation velocity of acoustic waves is greatly different, too. By varying the elastic coefficients of the acoustic wave propagating medium, various novel acoustic devices utilizing the above characteristics can be obtained.

17 Claims, 10 Drawing Sheets

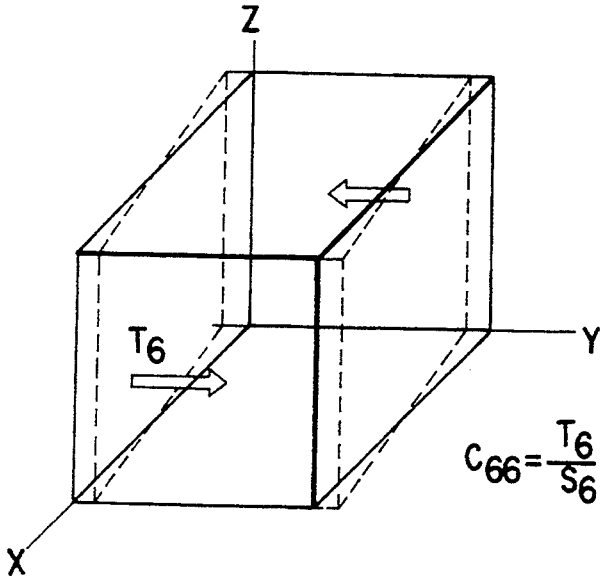
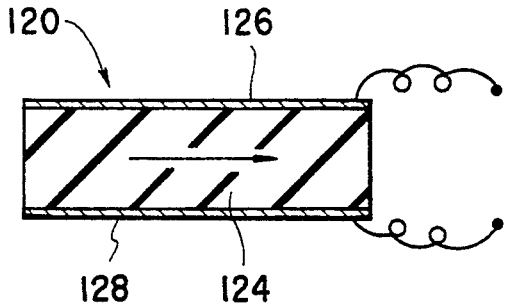
F I G. 19
F I G. 16
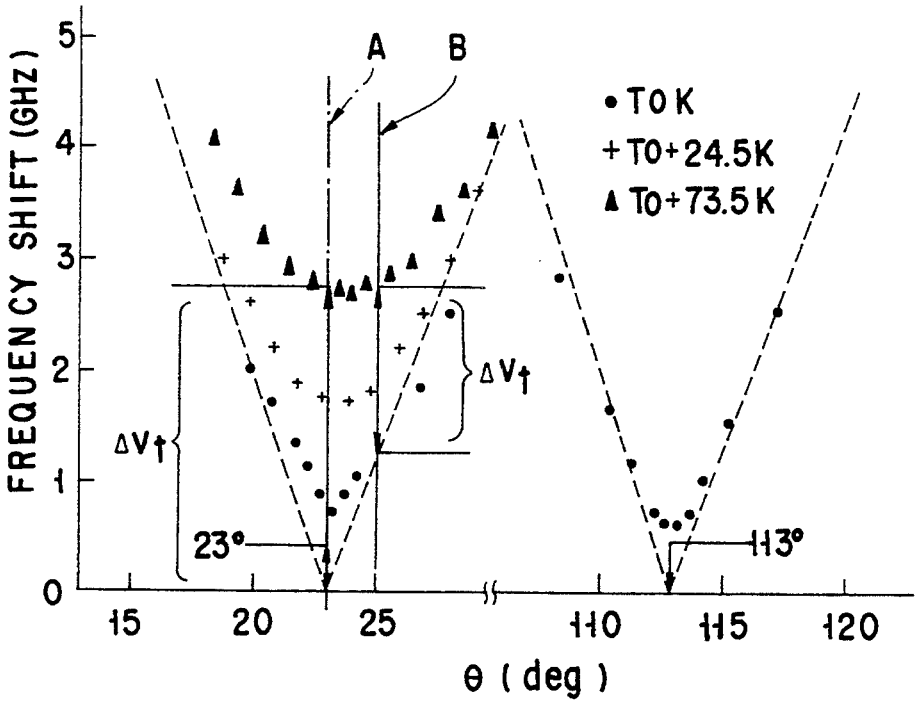
F I G. 17

FIG. 18
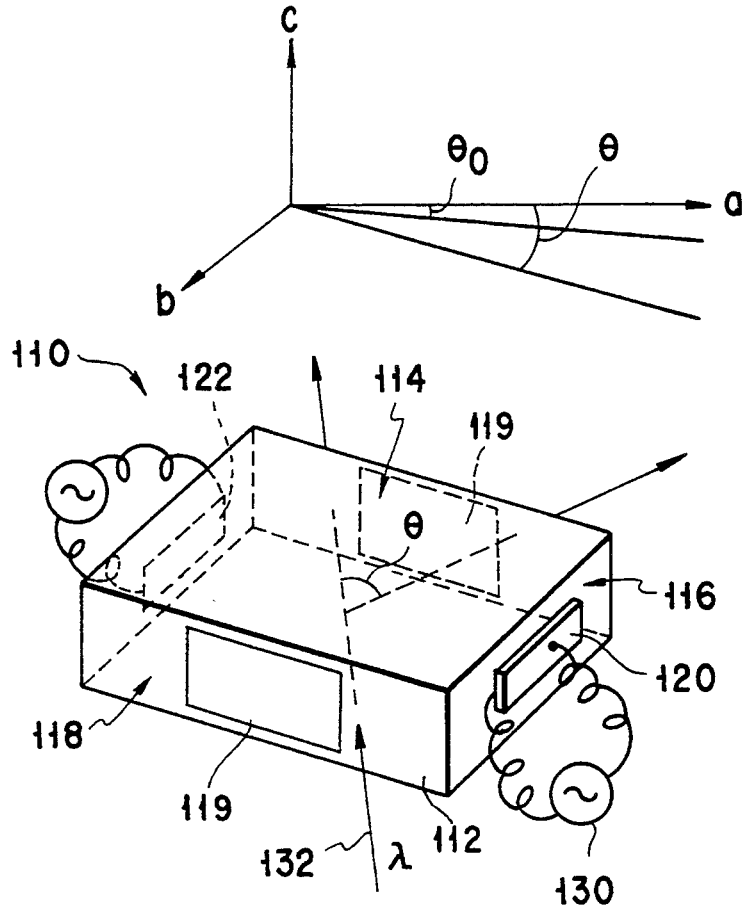
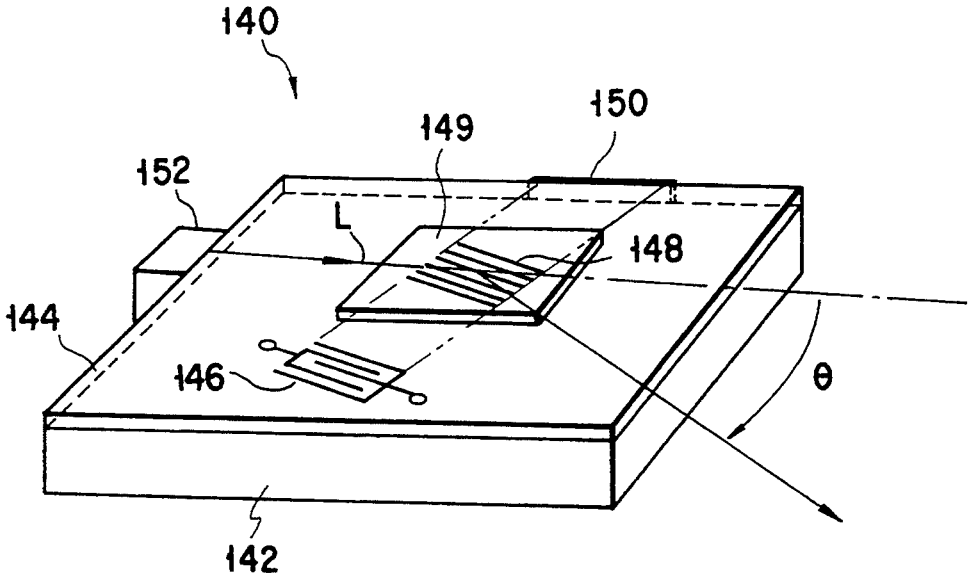
FIG. 20

ACOUSTIC DEVICE

BACKGROUND OF THE INVENTION

1. Field of the Invention

The present invention relates to acoustic devices including an acoustic lens, an ultrasonic delay line and an acoustic optical deflecting device.

2. Description of the Related Art

An acoustic lens is employed as a probe of a non-destructive testing device such as an ultrasonic microscope. The focal distance of the acoustic lens is substantially constant. If an acoustic lens capable of changing its focal distance is employed in this type of device, that is very convenient, and there is a great demand for such an acoustic lens. To meet the demand, an acoustic lens has been proposed, wherein a plurality of oscillators such as piezoelectric elements are arranged concentrically, and a driving voltage is applied to the oscillators successively from the outer ones toward the central ones with slight time lags, thereby generating convergent acoustic waves. The generated acoustic waves, however, are not acoustic waves obtained by converging plane waves, but are convergent acoustic waves obtained by superimposing a plurality of acoustic waves. Consequently, there is a problem that, owing to diffraction of respective acoustic waves from each oscillator, wave fronts, or phases, do not coincide.

An ultrasonic delay line comprises an acoustic wave propagating medium having an incidence face and an emission face. A time required until an incident ultrasonic wave incident on the incidence face is emitted from the emission face, i.e. a delay time, is determined by the shape of the acoustic wave propagating medium and acoustic velocity. An ultrasonic delay line capable of changing the delay time continuously has not yet been proposed.

In an acoustic optical deflecting device, a phase grating is produced within an acoustic wave propagating medium by ultrasonic waves. Utilizing optical diffraction by means of the phase grating, light is deflected. The response speed of the acoustic optical deflecting device is very excellent, compared to a mechanical optical deflector such as a polygonal mirror or a galvanomirror. Thus, this device has been regarded as very useful in the field of recent image processing or optical communication which require high-speed operations; however, a high deflecting angle is not obtained. In other words, a deflection efficiency is low. Under the situation, there is a demand for an acoustic optical deflecting device with high deflection efficiency.

SUMMARY OF THE INVENTION

An object of the present invention is to provide an acoustic device having an acoustic wave propagating medium capable of changing acoustic wave propagating speed.

Another object of the invention is to provide an acoustic optical deflecting device having a large deflection angle.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 16 shows a direction of stress and a direction of deformation due to stress;

FIG. 17 is a graph showing a variation of acoustic velocity in $LaNbO_4$ in relation to temperature variation;

FIG. 18 shows an acoustic optical deflecting device according to a fifth embodiment of the invention;

FIG. 19 shows a structure of a thickness shear vibrator shown in FIG. 18; and FIG. 20 shows another acoustic optical deflecting device.

DETAILED DESCRIPTION OF THE PREFERRED EMBODIMENTS

Before describing embodiments of acoustic devices of the present invention, the fundamental phenomena of this invention and theories thereof will now be described.

Figure 1:
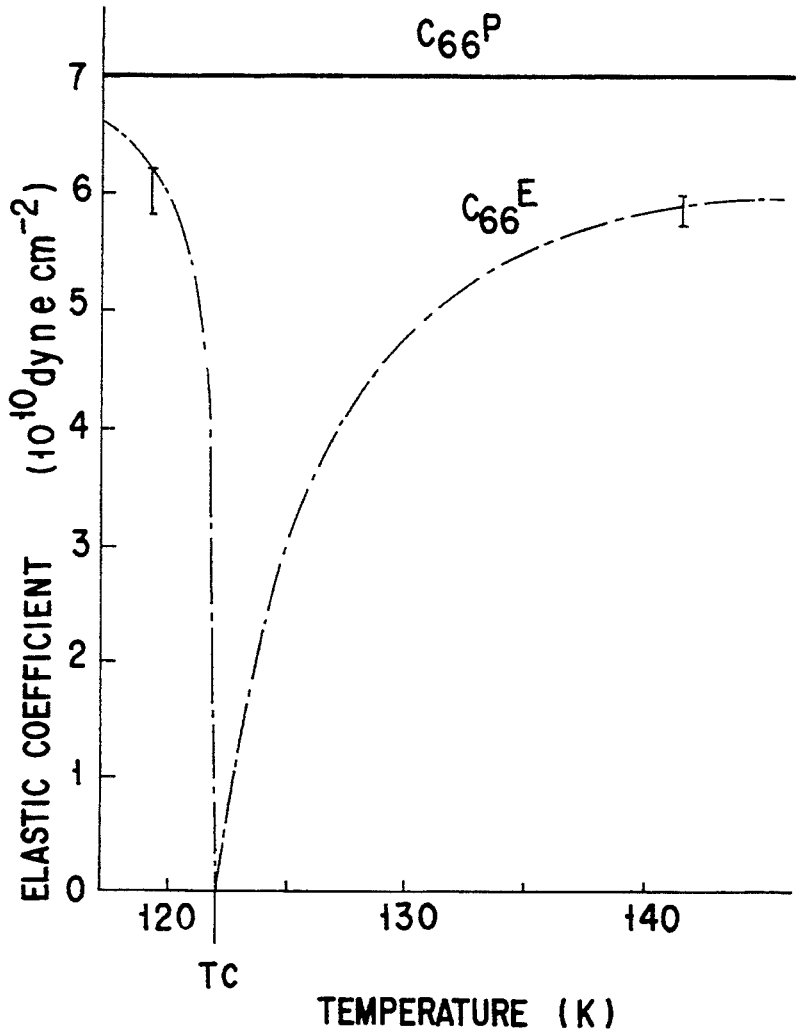
FIG. 1 is a graph showing an elastic coefficient/temperature characteristic of $KH_2PO_4$.
Figure 2:
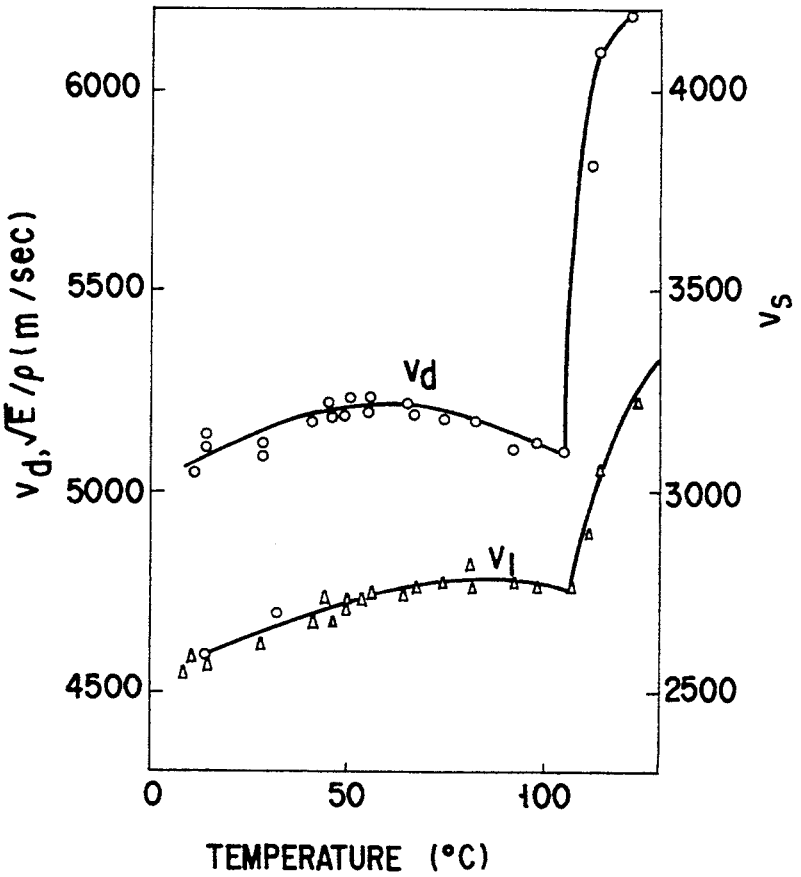
FIG. 2 is a graph showing an acoustic velocity/temperature characteristic of $BaTiO_3$ ceramics.

FIG. 1 shows an elastic coefficient/temperature characteristic of a typical ferroelectric substance, $KH_2PO_4$ (hereinafter abbreviated 37 KDP"), and FIG. 2 shows an acoustic velocity/temperature characteristic of $BaTiO_3$ ceramics. In FIG. 1, $C_{66}^P$ is an elastic coefficient at the time polarization is constant, and $C_{66}^E$ is an elastic coefficient at the time an electric field is constant. In other words, in FIG. 1, $C_{66}^P$ is an elastic coefficient at the time the switch is opened, and $C_{66}^E$ is an elastic coefficient at the time the switch is closed. In FIG. 2, $V_d$ and $V_s$ represent longitudinal and transverse waves, respectively.

In FIG. 1, what is to be noticed is that there is a large difference between $C_{66}^E$ and $C_{66}^P$ near a Curie point (Tc). The reason for this will now be explained. If a crystal exhibits a piezoelectric property in a paraelectric phase, prior to transition to a ferroelectric phase, the free energy F of the crystal is given by the following equation:

$$F=1/2\,(\chi^x)^{-1}p^2+aPx+1/2\,C^Px^2 \quad (1)$$

where a is a piezoelectric constant, and $C^P$ is an elastic coefficient. A free electrification rate $\chi^x$ is given by $$(\chi^X)^{-1} = (\chi^x)^{-1} - \frac{a^2}{C^P} \quad (2)$$

An elastic coefficient $C^E$ at the time of constant electric field (interelectrode short) is given by $$C^E = C^P - \frac{a^2}{(\chi^x)^{-1}} \quad (3)$$

From equations (2) and (3), the following equation is obtained:

$$\frac{C^E}{C^P} = \frac{(\chi^X)^{-1}}{(\chi^x)^{-1}} \quad (4)$$

In a crystal such as KDP, which transits to an intrinsic ferroelectric phase, the following equations are obtained:

$$(\chi^x)^{-1}=\alpha(T-T0) \quad (5)$$

$$C^P=\text{a constant} \quad (6)$$

According to the Landau theory, this means that an order-parameter is polarization P.

From equations (5) and (2), the following equation (7) is obtained:

$$(\chi^x)^{-}=\alpha(T-Tc) \quad (7)$$

when equations (5) and (7) are substituted in equation (4), the following equation (8) is obtained:

$$C^E = C^P\frac{T-Tc}{T-To} = C^P - \frac{a^2}{\alpha(T-T0)} \quad (8)$$

At transition temperature Tc, $\chi^X$ and $(C^E)^{-1}$ diverges. In equation (8), Tc is represented by $$Tc = T0 + \frac{a^2}{\alpha C^P} \quad (9)$$

Figure 4:
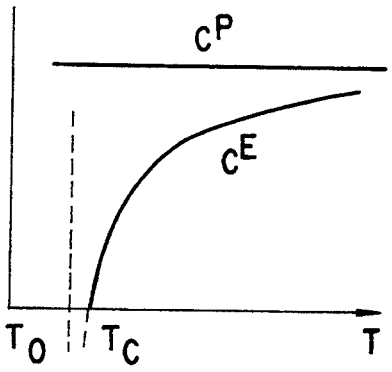
FIG. 4 is a graph showing an elastic coefficient/temperature characteristic of $BaTiO_3$ceramics.

As can be seen from equations (6) and (8), when the piezoelectric constant a $\neq 0$, a large difference appears near the Curie point (Tc) between the elastic coefficient $C^P$ at the time of constant polarization and the elastic coefficient $C^E$ at the time of constant electric field. This phenomenon is shown in FIG. 4. A horizontal line at the upper part of FIG. 4 indicates $C^P$ = a constant (corresponding to equation (6)). A hyperbolic line at the lower part of FIG. 4 corresponds to equation (8), and $C^E$ approaches straight line T=T0 as the temperature lowers and decreases hyperbolically. In other words, the difference between $C^P$ and $C^E$ increases infinitely. In FIG. 4, $C^P$ denotes an elastic coefficient at the time P=0, and $C^E$ an elastic coefficient at the time E=0.

The relationship between the elastic coefficients C and acoustic velocity is given by the following equation (10) when the density of material is $\rho$:

$$V = \sqrt{\frac{C}{\rho}} \quad (10)$$

The acoustic impedance $|Z|$ is expressed by $\rho v$. The reflectance R of ultrasonic waves incident on boundary surfaces with different acoustic impedances $Z_1$ and $Z_2$ is expressed by:

$$R = \frac{|Z_1 - Z_2|}{|Z_1| + |Z_2|} \quad (11)$$

The transmittance T is given by:

$$T = 1 - R\frac{2Z_2}{|Z_1| + |Z_2|} \quad (12)$$

Figure 3:
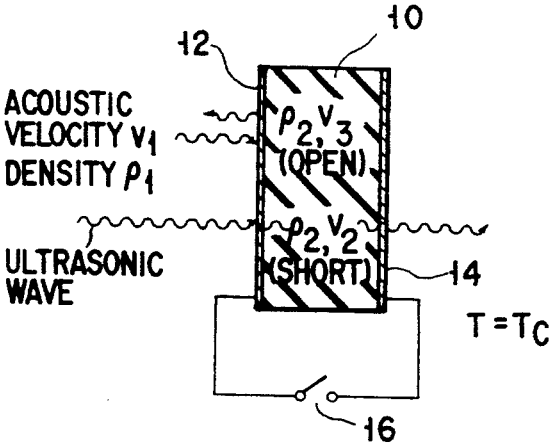
FIG. 3 shows a basic structure of the present invention.

As stated above, since the acoustic velocity v is proportional to the elastic coefficient C, various acoustic devices can be manufactured by utilizing the variation in acoustic velocity based on elastic abnormality near the Curie temperature. For example, as is shown in FIG. 3, electrodes 12 and 14 are provided on both side surfaces of an acoustic wave propagating medium 10 which exhibits elastic abnormality near the Curie temperature. The electrodes 12 and 14 are electrically connected via a switch 16. This structure functions as an acoustic shutter.

In the meantime, the Curie temperature of KDP shown in FIG. 1 is low, i.e. about 120K, and is not practical. In general, a change in acoustic velocity is steep near the Curie temperature, and a fabricated device is unstable to a temperature change and not practical.

Figure 5:
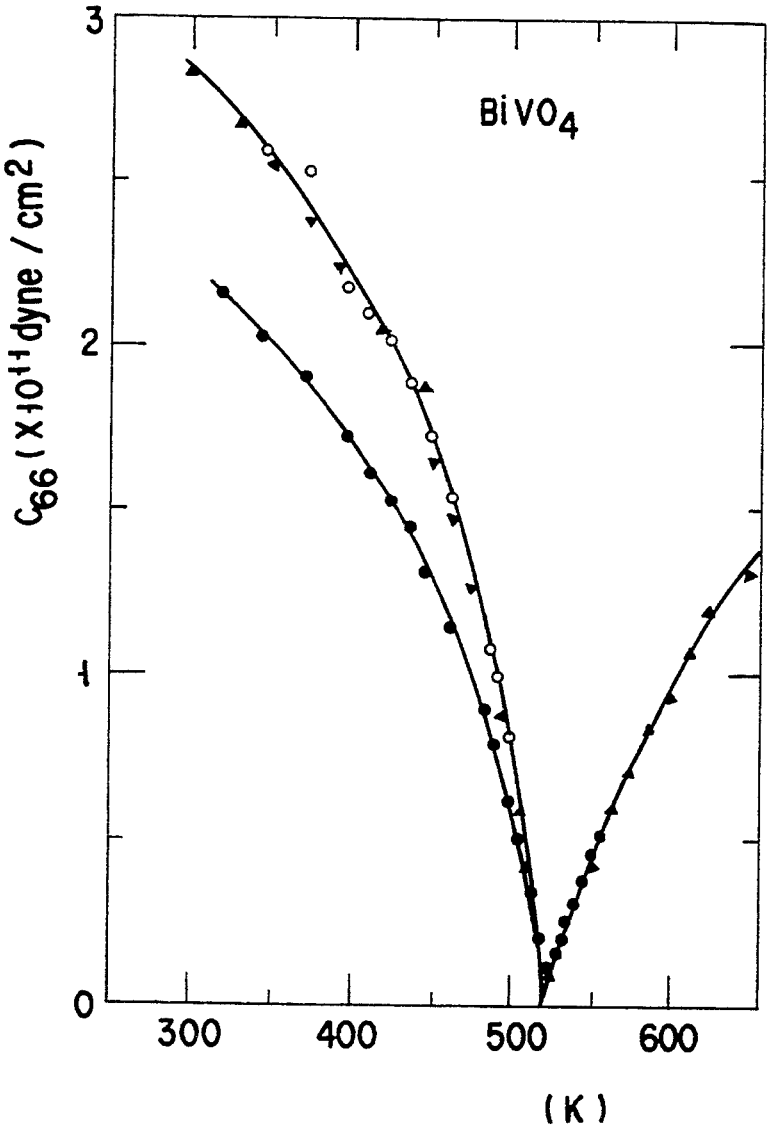
FIG. 5 is a graph showing an elastic coefficient/temperature characteristic of $BiVO_4$.
Figure 6:
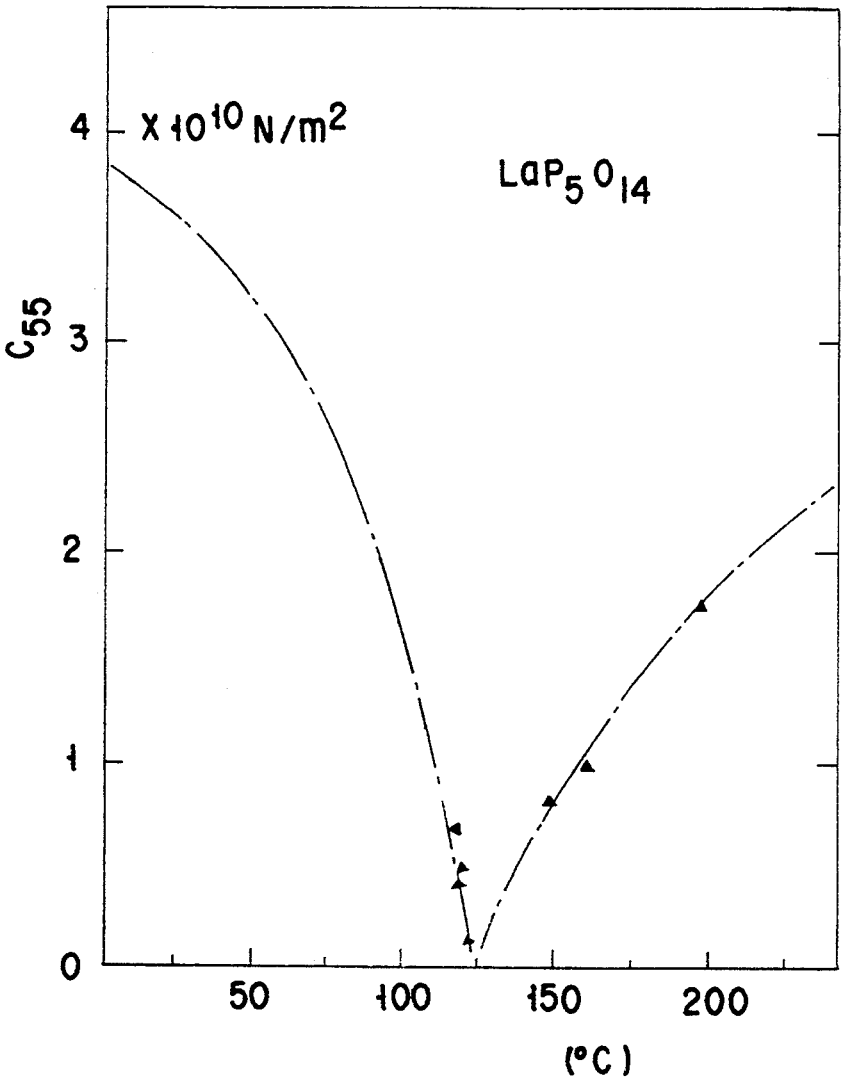
FIG. 6 is a graph showing an elastic coefficient/temperature characteristic of $LaP_5O_{14}$.

However, an elastic phase transition material having a Curie point at a temperature at which the material can be treated relatively easily has been discovered. Tanane ($C_9H_{18}NO$) of a molecular crystal exhibits a tetragonal-rhombic phase transition at 14° C. Tanane is a ferroelectric high-elastic material at low temperature phase. It is known that aniline HBr ($C_9H_5NH_3Br$) exhibits a rhombic (Pnaa)-monoclinic ($P2_1/C$) phase transition at 300K. As shown in FIG. 5, $BiVO_4$ has a slightly higher Curie temperature and exhibits a secondary structural phase transition at 528K and becomes a high-elastic substance at a low temperature phase. Other compounds having a similar zircon-type tetragonal crystal structure $MRO_4$ (M: Y or rare-earth element, R: V, As or P) have low phase transition temperatures; thus, practical use of $(Bi_{1-x}Dy_x)VO_4$ in which Bi is replaced by Dy, etc. is expected. In addition, as shown in FIG. 6, $LaP_5O_{14}$ exhibits rhombic-monoclinic phase transition at 398K, and in both phases a central symmetry or high-elastic phase transition is exhibited. It is thus understood that elastic abnormal temperatures of acoustic velocity can be made close to practical temperatures.

Accordingly, if these materials are used as acoustic wave propagating mediums, there can be obtained acoustic devices which utilize elastic abnormality in the vicinity of the Curie temperature and are operable at a temperature range relatively close to normal temperature.

Figure 7:
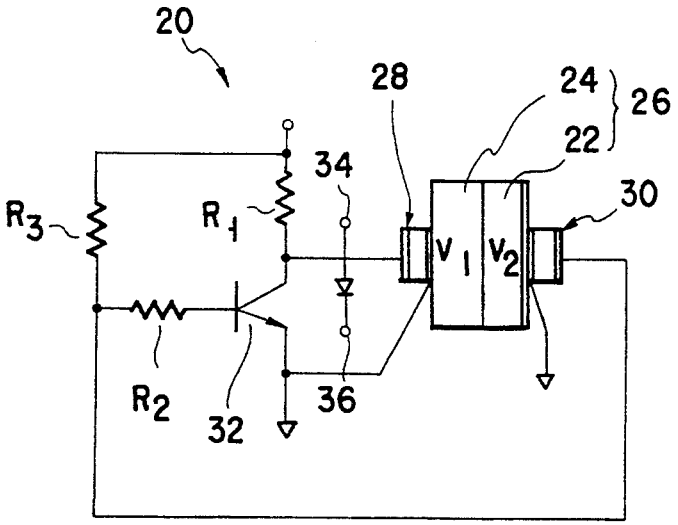
FIG. 7 shows a temperature switch according to a first embodiment of the invention.

A first embodiment of the present invention will now be described with reference to FIG. 7. An acoustic device of this embodiment functions as a temperature switch. A temperature switch 20 includes a material having a substantially constant acoustic wave propagation velocity irrespective of temperatures, e.g. quartz glass 24, and an acoustic wave propagating medium 26. The medium 26 is formed by coupling ferroelectric material, e.g. $Cs(Pb_{1-x}Sr_x)(Cl_{1-y}Br_y)_3$ 22, exhibiting elastic abnormality near the Curie temperature. A transmission piezoelectric oscillator 28 for generating acoustic waves is provided on the quartz glass 24 side of the medium 26. A receiving piezoelectric device 30 is provided on the $Cs(Pb_{1-x}Sr_x)(Cl_{1-y}Br_y)_3$ 22 side. A signal from the piezoelectric device 30 is fed back to the base of a transistor 32 via a resistor $R_2$. Accordingly, the acoustic wave propagating medium 26, piezoelectric oscillator 28, piezoelectric device 30, transistor 32 and resistors $R_1$, $R_2$ and $R_3$ constitute a self-excited oscillation type oscillation circuit. An oscillation output is delivered from a terminal 34, and a rectified output is taken from a terminal 36.

Where the propagation speed in the quartz glass 24 of acoustic waves generated by the piezoelectric oscillator 28 is $v_1$ and the propagation speed in $Cs(Pb_{1-x}Sr_x)(Cl_{1-y}Br_y)_3$ 22 is $v_2$, there is a large difference between $v_1$ and $v_2$ in a temperature range other than the Curie temperature Tc. Thus, acoustic waves are substantially reflected by the boundary plane between the quartz glass 24 and $Cs(Pb_{1-x}Sr_x)(Cl_{1-y}Br_y)_3$ 22, and this circuit does not oscillate. By contrast, $v_1=v_2$ at Curie temperature Tc, and most of acoustic waves pass through the boundary plane and reach the piezoelectric device 30. Thus, the circuit oscillates. In this way, the temperature switch 20 generates an oscillation output at a specific temperature (Curie temperature Tc). The oscillation frequency f is $f=v_1/2l$, where l is the thickness of the acoustic wave propagating medium 26. Accordingly, the material and thickness are determined so that the resonance frequency $f_r$ of the piezoelectric oscillator 28 and piezoelectric device 30 may be close to the oscillation frequency f. The elastic coefficient $C_{66}^E$ of $Cs(Pb_{1-x}Sr_x)(Cl_{1-y}Br_y)_3$ 22 changes steeply, as in the case of KDP of FIG. 1; thus, a high-precision oscillation output type temperature switch can be obtained.

Figure 8:
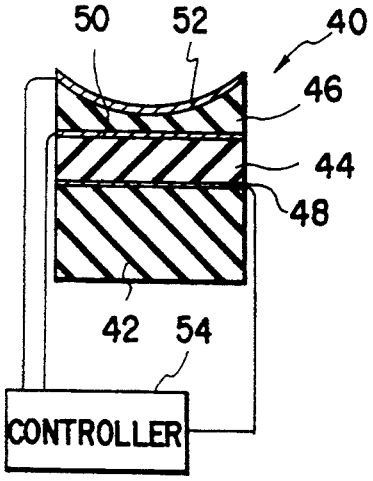
FIG. 8 is a side cross-sectional view of an acoustic lens according to a second embodiment of the invention.

A second embodiment of the invention will now be described with reference to FIGS. 8 and 9. An acoustic device of this embodiment is an acoustic lens used as an ultrasonic probe in a non-destructive testing (NDT) device. As is shown in FIG. 8, an acoustic lens 40 comprises a damping layer 42, a piezoelectric oscillator 44 for generating ultrasonic waves, and an acoustic wave propagating medium 46 formed of a ferroelectric substance exhibiting elastic abnormality at the Curie temperature and having a spherical concave surface. An electrode 48 is provided between the damping layer 42 and oscillator 44, and another electrode 50 is provided between the oscillator 44 and medium 46. The concave surface of the acoustic wave propagating medium 46 is provided with an electrode 52. The electrodes 48, 50 and 52 are connected to a controller 54. The controller 54 changes the conduction state between electrodes 50 and 52, applies a driving voltage across the electrodes 48 and 50 to drive the piezoelectric device 44, and includes an echo detecting circuit. When the driving voltage is applied across the electrodes 48 and 50, the piezoelectric device 44 generates ultrasonic waves within the acoustic wave propagating medium 46.

Figure 9:
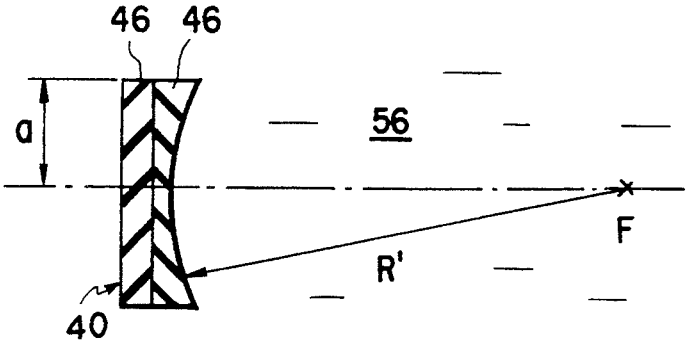
FIG. 9 shows a relationship between the acoustic lens of FIG. 8 and parameters.
Figure 10:
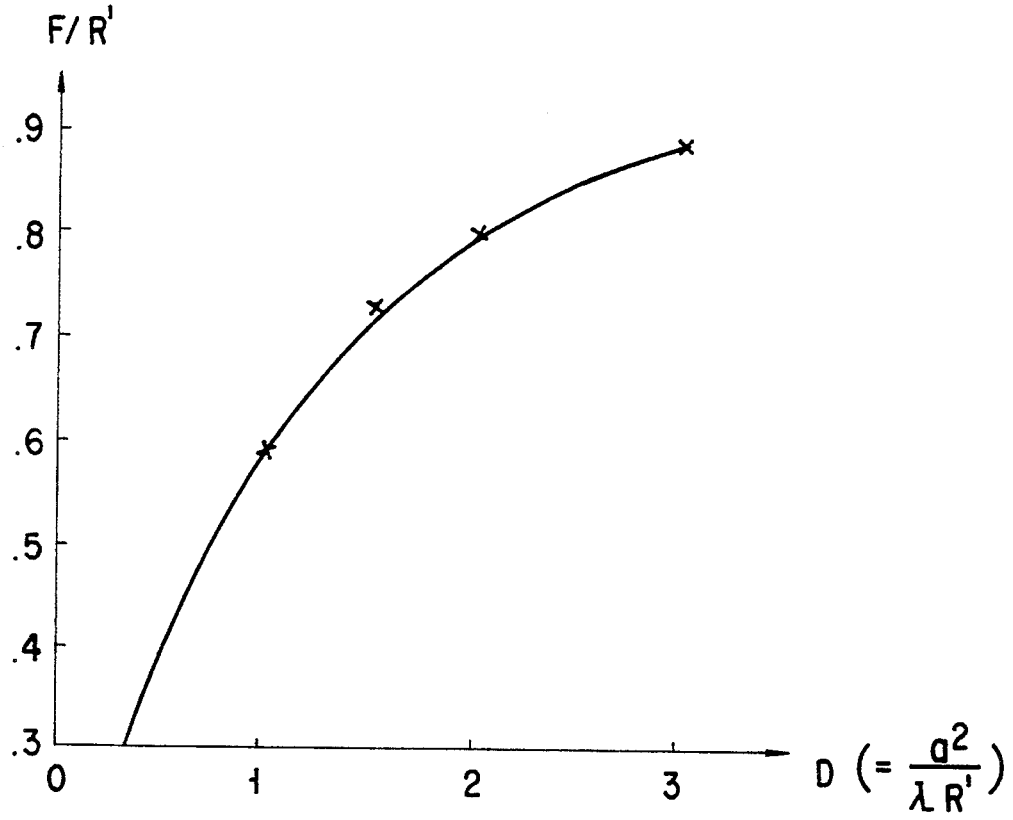
FIG. 10 is a graph showing a relationship between a constant D and F/R'.

In FIG. 9, the acoustic lens 40 is arranged such that its lens surface (concave surface) is put in contact with fluid 56. Since the acoustic velocity $v_s$ in the acoustic wave propagating medium 46 differs from the acoustic velocity $v_R$ in the fluid 56, plane waves generated from the piezoelectric oscillator 44 are refracted by the lens surface and converged. The convergence point (focal point) in this case does not coincide with the center of the radius of work curvature (i.e. the actual radius) R of the ultrasonic wave propagating medium 46. Where the distance between the actual convergence point (focal point) in the fluid and the lens surface is an apparent radius R′ of curvature, the following relationship exists between R and R′:

$$R' = \frac{R}{1 - \frac{V_R}{V_S}} \tag{13}$$

Where the aperture radius of the lens is a and $D=a^2/\lambda R'$, the relationship shown in FIG. 10 exists between the focal point F and a constant D.

For example, where the frequency f of ultrasonic waves is 7.5MHz, the opening $2a$ of the lens is 6.7 mmϕ, the radius R of work curvature of the lens surface is 15 mm, the acoustic velocity $v_R$ in fluid is 1500 m/s, and the acoustic velocity $v_s$ in the acoustic wave propagating medium is 2700 m/s, $R'=2.25$ and $D=1.66$. From FIG. 10. $F/R'=0.75$, i.e. $F=25.3$ mm. Under the same conditions, where the acoustic velocity $v_s$ in the acoustic wave propagating medium is changed to 6000 m/s, $R'=1.33$ R and $D=2.81$. From FIG. 10, $F/R'=0.9$ and $F=17.9$ mm.

The acoustic velocity in the acoustic wave propagating medium can be varied by changing the conduction state between the electrodes 50 and 52 by using the controller 54, and accordingly the focal distance can be varied.

Figure 11:
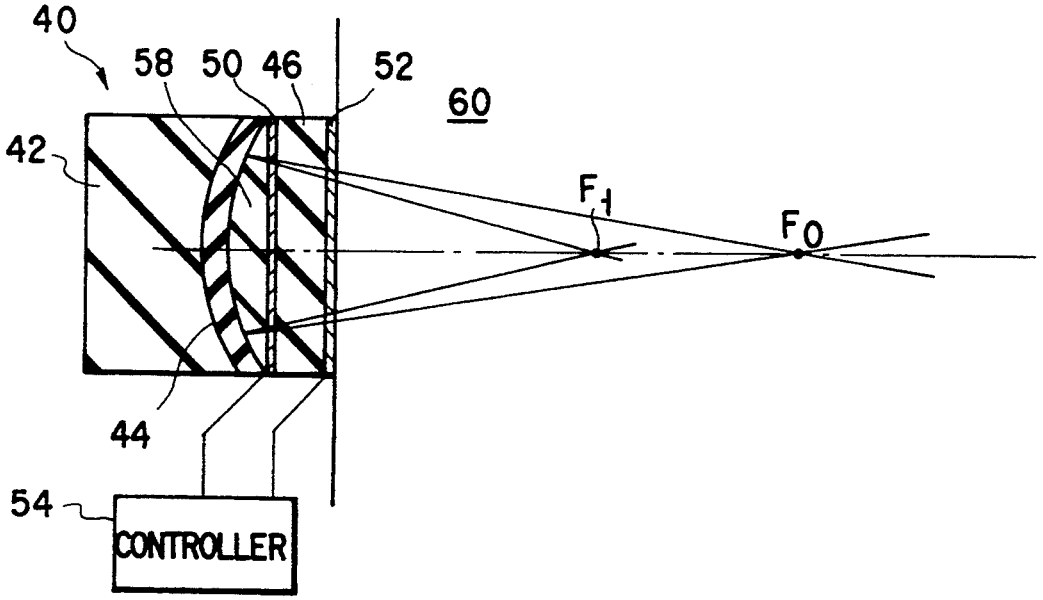
FIG. 11 is a side cross-sectional view of another acoustic lens.

A modification of this acoustic lens will now be described with reference to FIG. 11. In this modification, the piezoelectric oscillator 44 has a concave surface and generates convergent ultrasonic waves, and the ultrasonic wave propagating medium 46 is flat. The piezoelectric oscillator 44 is formed of, e.g. PZT (zircon lead titanate) ceramics. The acoustic wave propagating medium 46 is a ferroelectric substance such as KDP or $Cs(Pb_{1-x}Sr_x)(Cl_{1-y}Br_y)_3$, wherein x and y are selected so as to increase the difference between $C^P$ and $C^E$ at temperatures employed. The piezoelectric oscillator 44 is coupled to the acoustic wave propagating medium 46 via an acoustic coupler 58. The acoustic coupler 58 is formed by filling a material with good acoustic matching, e.g. epoxy resin adhesive, between the oscillator 44 and propagating medium 46. The acoustic lens 40 is put in direct contact with an object 60 to be tested. Like the above-described acoustic lens, the conduction state of the electrodes 50 and 52 on both side surfaces of acoustic wave propagating medium 46 is controlled by the controller 54. It is supposed that ultrasonic waves are converged at point F0 when the electrodes are opened. Then, if the electrodes 50 and 52 are closed, the acoustic velocity in the medium 46 varies and the refractive angle at the boundary plane varies. Consequently, ultrasonic waves are converged at point F1 which is different from point F0.

Figure 12:
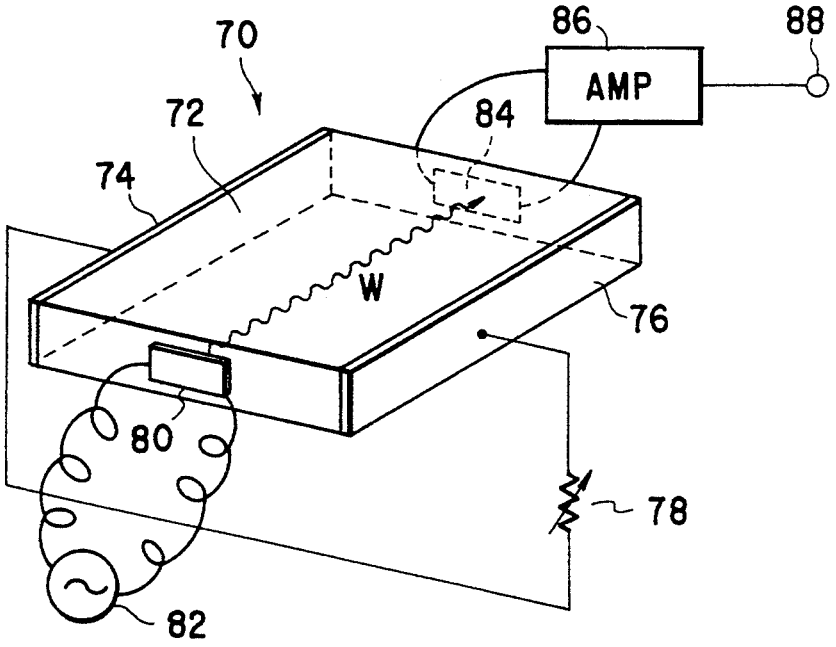
FIG. 12 shows a structure of an ultrasonic wave delay line according to a third embodiment of the invention.

A third embodiment of the invention will now be described with reference to FIG. 12. An acoustic device of this embodiment is an ultrasonic wave delay line. An ultrasonic wave delay line 70 comprises a rectangular parallelepipedic acoustic wave propagating medium 72 which exhibits elastic abnormality at the Curie temperature. Two electrodes 74 and 76 are provided on a pair of opposite surfaces of the acoustic wave propagating medium 72. The electrodes 74 and 76 are electrically connected via a variable resistor 78.

A piezoelectric oscillator 80 for generating ultrasonic waves is attached to a predetermined surface of the delay line 70. Upon receiving an electric signal from a signal source 82, the piezoelectric oscillator 80 generates ultrasonic waves W within the propagating medium 72. A piezoelectric device 84 for receiving ultrasonic waves is attached to that surface of the propagating medium 72 which is opposed to the piezoelectric oscillator 80. The piezoelectric device 84 converts received ultrasonic waves W to an electric signal. The obtained electric signal is output from a terminal 88 via an amplifier 86.

The velocity of ultrasonic waves propagating through the inside of the ultrasonic wave propagating medium 72 can be varied between $v_p=\sqrt{C^P/\rho}$ and $v_E=\sqrt{C^E/\rho}$ by adjusting the variable resistor 78. Accordingly, the time required until the ultrasonic waves W cross the propagating medium 72, that is, a delay time, can be varied continuously.

Figure 13:
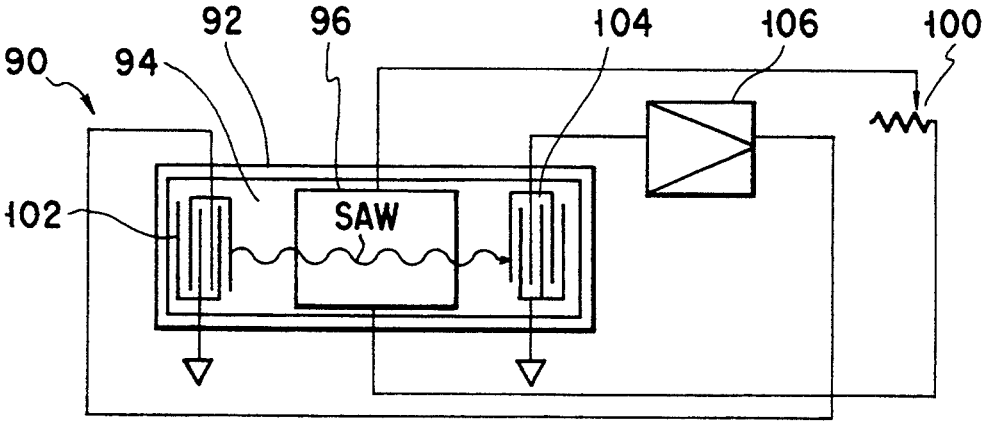
FIG. 13 shows a structure of an oscillator according to a fourth embodiment of the invention.
Figure 14:
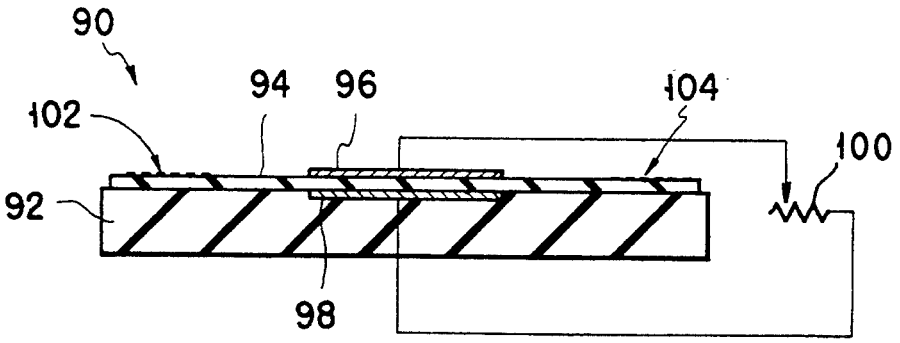
FIG. 14 is a side cross-sectional view of the oscillator of FIG. 13.

A fourth embodiment of the present invention will now be described with reference to FIGS. 13 and 14. An acoustic device of this embodiment constitutes an external resistance control type oscillator. An oscillator 90 has an insulating substrate 92 of glass or MgO, and a ferroelectric thin film (acoustic wave propagating medium) 94 exhibiting elastic abnormality at the Curie temperature. Electrodes 96 and 98 are provided on central portions of the upper and lower surfaces of the ferroelectric thin film 94. The electrodes 96 and 98 are electrically connected via a variable resistor 100. A pair of comb-shaped electrodes, i.e. IDTs (inter-digital transducer) 102 and 104 are provided on both end portions of the upper surface of the thin film 94. When a voltage varying with time is applied to the IDT 102, the IDT 102 generates surface waves SAW within the acoustic wave propagating medium 94. The IDT 104 converts received surface waves SAW to an electric signal. The IDTs 102 and 104 are electrically connected via an amplifier 106. The oscillation frequency of the oscillator 90 varies, depending on the time required for propagation of surface waves SAW between the IDT 102 and IDT 104, i.e. the velocity of surface waves within the acoustic wave propagating medium 92. Accordingly, the oscillation frequency can be varied by adjusting the variable resistor 100.

An acoustic optical deflecting device according to a fifth embodiment of the invention will now be described. Before describing the fifth embodiment, the basic principle of the acoustic optical deflecting device will first be explained.

When acoustic waves propagate through the inside of an optically transparent acoustic wave propagating medium (hereinafter, called "optical medium"), a change in refractive index occurs in proportion to an acoustic deformation. Thus, light incident on the optical medium is diffracted. This is called "acoustic optical effect." Utilizing the acoustic optical effect, the acoustic optical deflecting device deflects light. Diffraction by acoustic optical effect includes Raman-Nath diffraction and Bragg diffraction. The diffraction efficiency of Raman-Nath diffraction is low. On the other hand, Bragg diffraction is highly efficient and 100% diffraction efficiency can be attained. Thus, Bragg diffraction is principally employed in the acoustic optical deflecting device.

Figure 15:
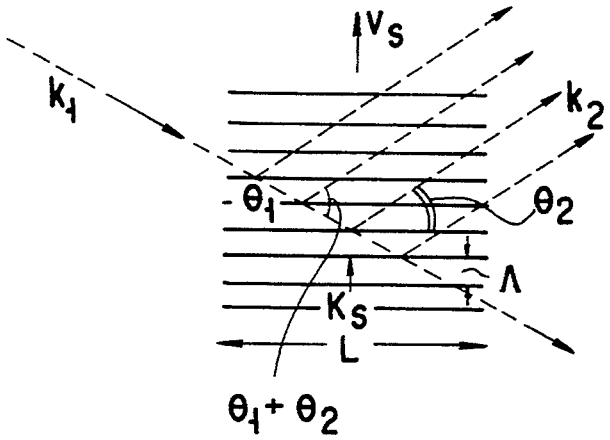
FIG. 15 illustrates Bragg diffraction.

Bragg diffraction will now be explained with reference to FIG. 15. Bragg diffraction occurs when thickness L of an acoustic wave beam is great and a light beam travels several spatial cycles. That is, the following relationship exists between light wavelength $\lambda$ and wavelength $\Lambda$ of acoustic wave:

$$L>>\Lambda^2/\lambda(=2\pi/K_s) \tag{14}$$

where $K_s$ is the number of acoustic waves. Where the number of waves of input light is $k_1$, and the number of waves of deflected light is $k_2$, the following relationship exists therebetween:

$$k_2=k_1\pm K_s \tag{15}$$

From a modification of the above condition, i.e.

$$\omega_2=\omega_1\pm\Omega_s>>\Omega_s \tag{16}$$

$k_1/k_2\approx 1$. Thus, the following equation is obtained:

$$\theta_1=\theta_2=\pm\sin^{-1}(K_s/2k_1)=\pm\sin^{-1}(\lambda/2\Lambda)\pm\lambda/2\Lambda \tag{17}$$

where the frequency of acoustic wave is f and acoustic velocity is $V_s$, $\Lambda=V_s/f$. Thus, the lower the acoustic velocity $V_s$, the greater the deflection angle. Accordingly, in order to obtain a large deflection angle, it is effective to use an optical medium with a low acoustic wave propagation velocity.

It is required that the optical medium convert an acoustic grating to an optical phase grating, i.e. refractive index grating with high efficiency. Where the acoustic deformation is S, refractive index is n and optical elastic constant is p, the refractive index variation $\Delta n$ is given by $$\Delta n=\frac{n^3}{2}pS \tag{18}$$

The following relationship exists between the acoustic deformation S occurring when acoustic power $P_s$ propagates with a cross section A (=L·H), and density d of medium:

$$S^2=\frac{2P_s}{dV_s^3A} \tag{19}$$

The deflection efficiency $\eta$ of the acoustic optical deflecting device is $$\eta=\left(\frac{k_0nL}{2}\right)^2 \tag{20}$$

and thus the following equations can be obtained:

$$\eta = \frac{\pi^2}{2\lambda_0^2} \frac{(n^6p^2)}{v_s^3} \frac{L}{H} P_s = \frac{\pi^2}{2\lambda_0^2} Me \frac{L}{H} P_s \quad (21)$$

It is therefore desirable that the optical medium have a high performance index Me, i.e. a high refractive index, a high optical-elastic coefficient, and a low acoustic velocity or a low elastic coefficient.

In order to obtain a large deflecting angle, it is desirable to use an optical medium in an acoustic optical deflecting device, which medium has a low acoustic wave propagation velocity and a high performance index. From the above, it can be thought to form an acoustic optical deflecting device by using a substance exhibiting elastic abnormality at the Curie temperature, such as ferroelectric substance, as material of the optical medium, and to use the deflecting device at a temperature in the vicinity of the Curie temperature. A specific example of the optical medium is KDP; however, considering the temperature at which the device is used, i.e. Curie temperature, $Cs(Pb_{1-x}Sr_x)(Cl_{1-y}Br_y)_3$ is desirable.

Although the above acoustic optical deflecting device can obtain a large deflection angle, the elastic coefficient ($C^E$) changes steeply in relation to a temperature variation, as shown in FIG. 1, and stability to temperatures is lacking. To solve this problem, the following measures have been thought.

In the figures showing elastic abnormalities in the vicinity of the Curie temperature, the values in the ordinate are $C_{44}$, $C_{55}$ or $C_{66}$ in most cases. As shown in FIG. 16, both directions of stress and deformation due to stress are elastic coefficient tensors along crystal axes, which correspond to transverse wave propagation of acoustic waves. The above description is based on transverse acoustic wave propagation along crystal axes. For example, when transverse waves are propagated in X-direction so as to generate stress in the direction of $T_6$, a sliding deformation occurs in the direction of $T_6$ and is propagated in the X-direction. By contrast, when the direction of transverse wave propagation is displaced from the crystal axis, it is understood that stability of temperature characteristic is obtained. (Details are disclosed in "Y. ISHIBASHI et al 'The Ferroelastic Transition In Some Sheelite-type Crystals,' Physica B 150(1988), pages 258–264").

Although the propagation along the crystal axes has been mentioned in the above, the temperature characteristics shown in FIGS. 1, 2, 5 and 6 are, in fact, the characteristics obtained at specific angle $\theta_0$ corresponding to respective materials. Regarding $BiVO_4$ and $LaNbO_4$, propagation coincides with the crystal axis at $\theta_0=0$ in the case of tetragonal crystal of $c_{16}=0$. The following relationship exists between elastic coefficients $c_{16}$, $c_{11}$, $c_{12}$ and $c_{66}$:

$$(c_{11}-c_{12})c_{66}=2c_{16}^2 \quad (22)$$

The following relation exists between these elastic coefficients and the specific angle $\theta_0$:

$$\tan 4\theta_0=4c_{16}/(c_{11}-c_{12}-2c_{66}) \quad (23)$$

Accordingly, at the secondary phase transition point, the following relationship exists:

$$\tan 2\theta_0=c_{66}/c_{16} \quad (24)$$

When transverse waves are propagated at an angle displaced from the inherent angle $\theta_0$, the variation in acoustic velocity due to temperature variation is not steep. FIG. 17 shows the dependency of acoustic velocity upon the transverse wave propagation direction in $LaNbO_4$. In $LaNbO_4$, the inherent angle $\theta_0$ exists at 23 degrees and 113 degrees from the a axis. For example, regarding 23 degrees (indicated by A) and 25 degrees (indicated by B), it is understood that the acoustic velocity variation $\Delta v_t$ actually decreases in relation to the temperature difference of 73.5 K. In this way, the acoustic velocity difference decreases as the angle of propagation departs from the inherent angle $\theta_0$.

An acoustic optical deflecting device according to a fifth embodiment of the invention will now be described with reference to FIGS. 18 and 19. An acoustic optical deflecting device 110 has an optical medium 112 of a single crystal substrate of scheelite-type compound of $BiVO_4$ or $LaNbO_4$ or $(Bi_{1-x}Dy_x)VO_4$. The single crystal is synthesized by an ordinary melting pull-up method. Surfaces 114, 116 and 118 of the optical medium 112 are determined in the following manner. First, C-surface 114 is formed by cutting perpendicular to a c-axis. Then, an a-axis is determined by using x-rays, and A-surface 116 is formed by cutting perpendicular to an axis displaced from the a-axis by $\theta$. Finally, B-surface 118 is formed by cutting perpendicular to both A-surface 116 and C-surface 114. An electrode 119 for control of $C^E$ is mounted on each of the two B-surfaces 118 such that the electrodes 119 face each other across the optical medium 112. A thickness shear vibrator 120 is attached to one side of A-surface 116 by means of an epoxy resin adhesive, etc. As is shown in FIG. 19, the thickness shear vibrator 120 comprises PZT (zircon lead titanate) ceramics 124 polarized in the plane direction (indicted by an arrow) and electrodes 126 and 128 of chromium/gold, titanium/gold, etc. provided on the upper and lower surfaces of the ceramics 124 (parallel to the polarization direction). When a voltage of frequency f is applied from an oscillator 130 to the electrodes 126 and 128, the thickness shear vibrator 120 generates ultrasonic waves within the optical medium 112. Where the acoustic velocity in the optical medium 112 is $v_t$, the wavelength $\lambda$ of generated ultrasonic waves is given by $\lambda=v_t/f$. An acoustic wave absorbing thickness shear vibrator 122 having the same structure as the vibrator 120 is attached to the surface opposed to the vibrator 120 by means of an epoxy resin adhesive, etc. The thickness shear vibrator 122 converts received ultrasonic waves to an electric signal and prevents reflection of ultrasonic waves. The acoustic grating produced in the optical medium 112 is converted to an optical diffraction grating according to equation (18), as stated above. Accordingly, the light beam 132 incident on the optical medium 112 is deflected. FIG. 18 shows only a basic part of the acoustic optical deflecting device; however, there are provided, in fact, a damping material for suppressing multiple reflection of ultrasonic waves in the optical medium, a reflection-preventing film for suppressing reflection of incident/emission light, etc.

Another acoustic optical deflecting device will now be described with reference to FIG. 20. An acoustic optical deflecting device 140 comprises a thin-film waveguide or optical medium 144. The optical medium 144 is formed by depositing a material having piezoelectric property at temperatures above and below the phase transition temperature onto a substrate 142 of $SrTiO_3$, MgO, etc. by means of sputtering, MOCVD or MBE. An IDT (inter-digital transducer) electrode 146 is provided on the surface of the optical medium 144. The optical medium 144 has piezoelectric property, and, when an AC voltage is applied to the IDT electrode 146, surface elastic waves 148 are excited in the optical medium 144 and an acoustic grating is formed. The acoustic grating is converted to an optical diffraction grating by optical elastic effect. The IDT electrode 146 is situated so as to propagate the surface elastic waves 148 in a direction displaced from a specific angle $\theta_0$ by a predetermined angle. An electrode 149 for controlling $C^E$ is provided on each side surface of the optical medium 144 such that that part of the medium 114, through which surface elastic waves 148 propagate, is interposed between the electrodes 149. An absorption film 150 such as silicone rubber, etc. is formed on that side surface of the optical medium 144, which is situated along the direction of propagation of surface elastic waves 148, thereby preventing reflection of surface elastic waves 148. A light beam L emitted from a light source 152 is deflected by the optical diffraction grating produced in the optical medium 144 by an angle $\theta$. In this example, formation of a thin film is difficult, but there is an advantage that a large band is obtained by using surface elastic waves.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An acoustic device comprising:

an acoustic wave propagating medium made of a material having an elastic coefficient which changes rapidly at a Curie temperature;

a pair of electrodes provided on said acoustic wave propagating medium; and control means, connected to said pair of electrodes, for controlling a state of conduction between said pair of electrodes, without applying an external electric field across said acoustic wave propagating medium.

2. The acoustic device according to claim 1, wherein said control means comprises switch means for switching the state of conduction between said electrodes between an open state and a short state.

3. The acoustic device according to claim 1, wherein said control means comprises variable resistor means for varying the state of conduction between said electrodes in a continuously variable manner.

4. An acoustic device comprising:

a first acoustic wave propagating medium made of a material having an elastic coefficient which changes rapidly at a Curie temperature; and a second acoustic wave propagating medium made of a material having a predetermined elastic coefficient, and which is surface-coupled to said first acoustic wave propagating medium, wherein transmission/nontransmission of acoustic waves traveling from said second acoustic wave propagating medium to said first acoustic wave propagating medium through a boundary plane is controlled by temperatures.

5. The acoustic device according to claim 2, further comprising acoustic wave generating means for generating plane acoustic waves within the acoustic wave propagating medium, and wherein:

said acoustic wave propagating medium has a spherical surface for converging the plane acoustic waves, and said switch means is adapted to change the focal point of the plane acoustic waves.

6. The acoustic device according to claim 3, further comprising acoustic wave generating means for generating plane acoustic waves within the acoustic wave propagating medium, and wherein:

said acoustic wave propagating medium has a spherical surface for converging the plane acoustic waves, and said variable resistor means is adapted to change the focal point of the plane acoustic waves in a continuously variable manner.

7. The acoustic device according to claim 2, further comprising acoustic wave generating means for generating convergent acoustic waves within the acoustic wave propagating medium, wherein said switch means is adapted to change the focal length of the acoustic waves.

8. The acoustic device according to claim 3, further comprising acoustic wave generating means for generating convergent acoustic waves within the acoustic wave propagating medium, wherein said variable resistor means is adapted to change the focal point of the acoustic waves in a continuously variable manner.

9. The acoustic device according to claim 3, wherein said acoustic wave propagating medium has an incidence surface and an emission surface, said acoustic device emits acoustic waves incident on the incidence surface from the emission surface after passing of a predetermined time, and said variable resistor means is adapted to vary said predetermined time in a continuously variable manner.

10. The acoustic device according to claim 3, further comprising acoustic wave generating means for generating acoustic waves within the acoustic wave propagating medium and conversion means for converting the acoustic waves propagating through the acoustic wave propagating medium to an output electric signal having an oscillation frequency, wherein said acoustic wave generating means is driven by the electric signal, and consequently an oscillation circuit is constituted, and said variable resistor means is adapted to vary the oscillation frequency of the output electric signal in a continuously variable manner.

11. The acoustic device according to claim 1, wherein said acoustic wave propagating medium is optically transparent.

12. The acoustic device according to claim 11, further comprising acoustic wave generating means for generating plane acoustic waves within the acoustic wave propagating medium and wavelength varying means for varying the wavelength of the generated acoustic waves, wherein a light beam incident on the acoustic wave propagating medium is deflected in a predetermined direction and the direction of deflection can be varied by varying the wavelength of the acoustic waves.

13. The acoustic device according to claim 12, wherein said acoustic wave generating means generates plane acoustic waves, the propagation direction of which is displaced from a crystal axis of a material which constitutes the acoustic wave propagating medium.

14. The acoustic device according to claim 1, wherein said acoustic wave propagating medium is an optically transparent ferroelectric substance.

15. The acoustic device according to claim 14, further comprising acoustic wave generating means for generating plane acoustic waves within the acoustic wave propagating medium and wavelength varying means for varying the wavelength of the generated acoustic waves, wherein a light beam incident on the acoustic wave propagating medium is deflected in a predetermined direction and the direction of deflection can be varied by varying the wavelength of the acoustic waves.

16. The acoustic device according to claim 15, wherein said acoustic wave generating means generates plane acoustic waves, the propagation direction of which is displaced from a crystal axis of a material which constitutes the acoustic wave propagating medium.

17. The acoustic device according to claim 16, wherein said acoustic wave propagating medium has a piezoelectric property, and said acoustic wave generating means is an inter-digital transducer.

* * * * *